United States Patent [19]

Wittmaier

[11] 4,352,087

[45] Sep. 28, 1982

[54] FUME DETECTOR AND ALARM SYSTEM

[75] Inventor: Edward A. Wittmaier, St. Charles, Mo.

[73] Assignee: Marie C. Kercheval, St. Charles, Mo.

[21] Appl. No.: 256,386

[22] Filed: Apr. 22, 1981

[51] Int. Cl.[3] ..... G08B 17/10

[52] U.S. Cl. ..... 340/632; 340/634; 422/98; 73/23

[58] Field of Search ..... 340/632, 633, 634; 73/23, 27 R; 422/98

[56] References Cited

U.S. PATENT DOCUMENTS

| | | | |
|---|---|---|---|
| 3,801,972 | 4/1974 | Ho Kim et al. | 340/634 X |
| 3,879,717 | 4/1975 | Gruensfelder | 340/634 X |
| 3,950,739 | 4/1976 | Campman | 340/634 X |
| 4,007,456 | 2/1977 | Paige et al. | 340/634 X |
| 4,177,668 | 12/1979 | Holmberg | 340/634 X |
| 4,185,491 | 1/1980 | Owen | 340/634 X |
| 4,235,096 | 11/1980 | Yasuda et al. | 73/23 |
| 4,250,829 | 2/1981 | Stephens, Jr. | 340/634 X |
| 4,258,563 | 3/1981 | Yasuda et al. | 73/23 |
| 4,267,505 | 5/1981 | Biglin | 340/634 X |
| 4,306,444 | 12/1981 | Hattori et al. | 73/23 |

FOREIGN PATENT DOCUMENTS

| | | | |
|---|---|---|---|
| 54-136898 | 10/1979 | Japan | 340/634 |

*Primary Examiner*—John W. Caldwell, Sr.

*Assistant Examiner*—Daniel Myer

*Attorney, Agent, or Firm*—Charles B. Haverstock; Robert M. Garrett; Herbert B. Roberts

[57] ABSTRACT

A fume detector including a gas sensor having a heater element and a variable impedance element associated therewith whose impedance decreases in the presence of toxic gases or fumes, or a decrease of free oxygen in an atmosphere being monitored. A load resistor in series circuit with the gas sensor and a pair of series connected potentiometers in parallel circuit with the gas sensor and the load resistor form a Wheatstone bridge. A first voltage comparator connected to one of the potentiometers and a reference voltage provides a signal when the supply voltage decreases below a predetermined level. A second voltage comparator connected to the other potentiometer and a junction between the gas sensor and the load resistor provides a signal when the gas sensor fails in the open circuit condition. A third voltage comparator connected across the bridge provides a signal when a toxic gas condition exists. The first, second and third voltage comparator outputs are commonly connected to the input of a fourth voltage comparator. A warning device is connected to the output of the fourth voltage comparator and is energized when any one of the signals of the first, second and third voltage comparators falls below a predetermined level.

12 Claims, 1 Drawing Figure

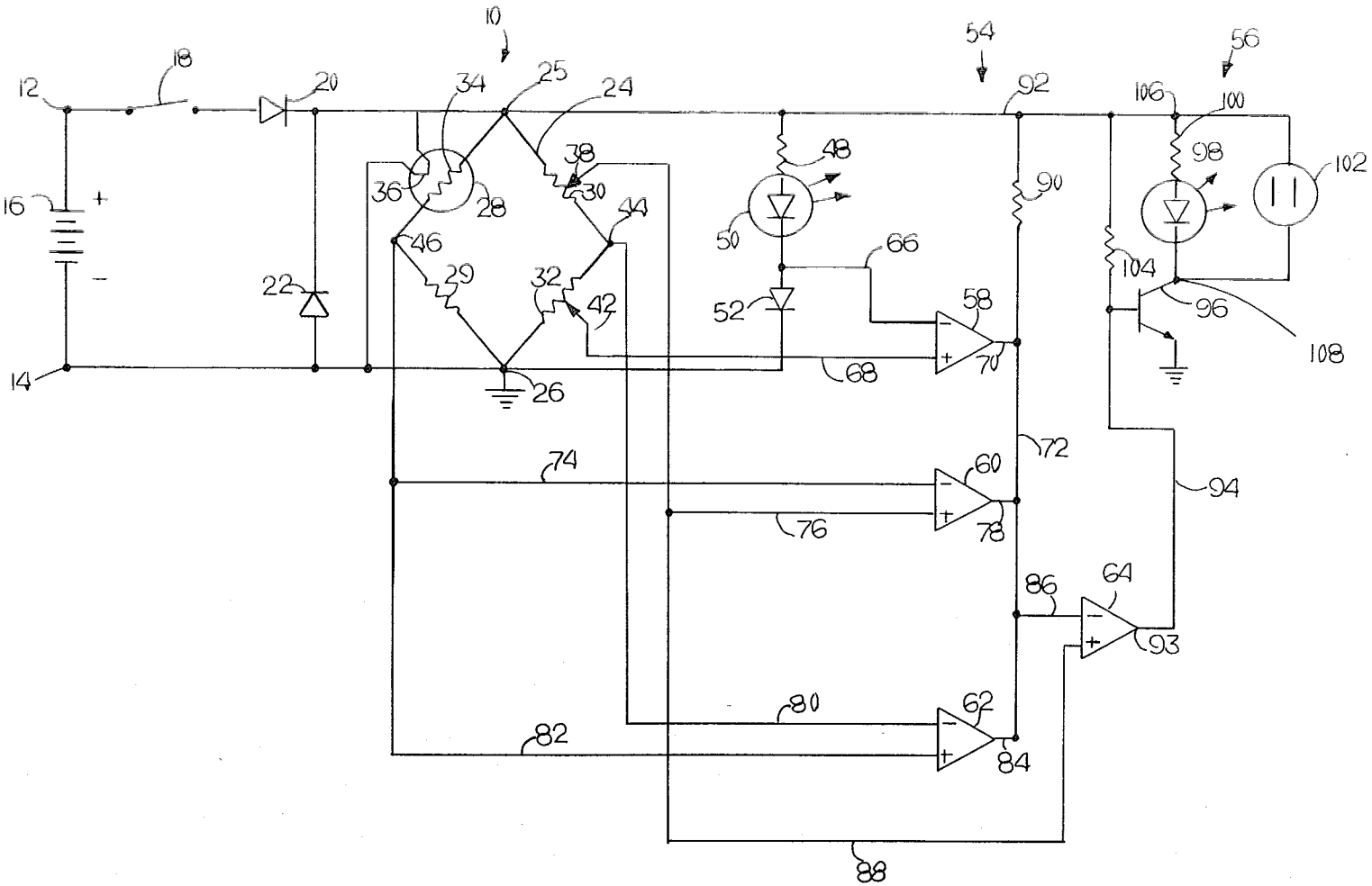
10
12
14
16
18
20
22
24
25
26
28
29
30
32
34
36
38
42
44
46
48
50
52
54
56
58
60
62
64
66
68
70
72
74
76
78
80
82
84
86
88
90
92
93
94
96
98
100
102
104
106
108

FUME DETECTOR AND ALARM SYSTEM

The present invention relates to an apparatus for monitoring contaminating gases of fumes in the ambient or other atmosphere, and for sounding a visible and/or audible alarm when the concentration of contaminating gases or fumes exceeds a predetermined level.

In many situations the living space or work space of workmen, crews, operators, passengers or others in various marine craft or vehicles and other environs is such that the atmosphere may become contaminated with combustible or toxic gases or fumes posing a threat to the health or safety of exposed individuals. This is particularly true in the case of sleeping quarters and engine rooms of boats particularly commercial boats, recreational vehicles, off-shore drilling rigs, over-the-road trucks, mini-subs and other places which may be invaded by the gases or fumes of power plants or fuel compartments and these gases or fumes may become concentrated to a dangerous level. The working areas in mines, sewers, factories, bag-houses, and like places may also be subject to concentrated gases or fumes given off during mining, factory or other operations. These and similar areas should be monitored to indicate the presence of unsafe or unhealthful atmospheric conditions. The present device is a fume or gas detector which uses a gas sensor having a heating element and a gas sensing element, wherein the impedance of the sensing element decreases in the presence of contaminating gases or fumes or upon the depletion of oxygen in the atmosphere being monitored. The subject gas sensor is connected in a circuit which includes an audible warning device that sounds or otherwise produces an alarm when the contaminating gases or fumes increase above some predetermined level, or if the free oxygen in the atmosphere decreases below some predetermined level. The circuit also includes means to give the alarm if the voltage of an energizing device or power supply for the present sensor circuit decreases below a certain level, or if the gas sensing element fails by becoming open circuited. The device may also include a visual warning indicator which provides a visual indication if the warning circuit has been energized to show this condition. The device may be energized by a battery including a rechargeable battery pack thereby making the device completely portable, or it may be energized from a main power source by using an A.C. to D.C. converter thereby allowing the device to be permanently installed and plugged into an electrical outlet.

Prior art devices which have been considered and which are of some general interest to show the state of the art are disclosed in U.S. Pat. Nos. 3,482,233; 3,678,489; 3,735,382; 3,750,123; 3,801,972; 3,879,717; 3,955,186; 4,007,456; 4,064,498; 4,127,024; and 4,219,806.

It is therefore a principal object of the present invention to teach the construction and operation of improved means for responding to the concentration of contaminating gases or fumes or the depletion of oxygen in the ambient atmosphere being monitored.

Another object is to teach the construction of a fume detector having low voltage alarm means and an adjustment to set the point at which the low voltage condition will produce a signal to indicate the condition.

Another object is to teach the construction of an improved fume detector which is completely portable and which is relatively inexpensive to make.

Another object is to provide a fume detector which gives an audio and/or visual warning if the concentration of gases or fumes exceeds some preestablished level or if the oxygen in the environment being monitored of the power supply used energizing the device and falls below a predetermined level, or if the sensor element employed in the device fails in either the open or short circuited condition.

Another object is to provide a relatively small compact fume sensor or detector which is portable and can be carried on the person or placed at any convenient location when in use.

These and other objects and advantages of the present device will become apparent after considering the following detailed specification in conjunction with the accompanying drawing which is a schematic circuit diagram of a preferred embodiment of the device.

Referring to the drawing more particularly by reference numbers, number 10 identifies a fume detector circuit constructed according to the present invention. The circuit 10 has input terminals 12 and 14 for connecting a source of electrical energy such as battery 16, a rechargeable battery pack, or an A.C. to D.C. converter device connected to convert A.C. voltage such as available at a wall outlet to the D.C. voltage required to operate the circuit.

An on-off switch 18 is provided for turning the device 10 on and off. A diode 20 is connected in series with the switch 18 and another diode 22 is connected in a parallel circuit with the battery 16 to prevent damage to the circuit if the battery 16 or other energy source is connected with its polarity reversed.

The circuit 10 includes a bridge circuit such as Wheatstone bridge circuit 24 having a supply voltage terminal 25, a grounded opposite terminal 26, a gas sensor element 28 in one branch in series with a load resistor 29 across the inputs of the bridge circuit. The bridge 24 has tappered impedances such as has potentiometers 30 and 32 in the other two branches forming a voltage divider. The gas sensor 28 has a variable impedance element 34 connected in one of the other branches of the bridge, and a heater element 26 is associated therewith. When the power switch 18 is closed, the heater element 36 is connected across the battery 16 and is energized to heat the element 34. After a period of time when the switch 18 is closed, the heater element 36 will cause the element 34 to reach its operating temperature as indicated by a stabilizing of the impedance of the element 34. The stabilizing condition may vary for the particular condition being monitored in the ambient atmosphere thereby also establishing an output voltage across the load resistor 29 which is in series with the element 34. In the presence of contaminating gases or fumes in the ambient atmosphere, or a depletion of oxygen in the atmosphere, the impedance of the variable impedance element 34 decreases causing a greater portion of the supplied voltage to be across the load resistor 29 which therefore rises. The voltage across the resistor 29 is the voltage that is monitored to detect gases, fumes or a depletion of oxygen in the atmosphere as will be explained later. A suitable detector for the element 28 is a gas sensor model 12v4pg available from the Majima Company Limited of Tokyo, Japan.

The potentiometer 30 has an adjustable tap 38 which is adjusted to adjust the voltage between the adjustable tap 38 and the grounded terminal 26 of the bridge circuit 24. The potentiometer 32 has an adjustable tap 42 which is adjusted to adjust the voltage between the adjustable tap 42 and the grounded terminal 26. The bridge circuit 24 also has a terminal 44 between the potentiometers 30 and 32, and a terminal 46 between the sensor 28 and the load resistor 29.

A resistor 48 and a light emitting diode (LED) 50 are connected in series circuit with a voltage reference diode 52, with the resistor 48, the LED 50 and the diode 52 across the terminals 25 an 26 of the Wheatstone bridge circuit 24. The LED 50, which may be of some desired color such as green, provides a visual on-off signal which indicates that the switch 18 is closed and the circuit 10 is energized.

The circuit 10 further includes a voltage comparator circuit 54, and a warning circuit 56 which is energized by the voltage comparator circuit 54 under certain circumstances as will be described. The voltage comparator circuit 54 includes a quad voltage comparator integrated circuit chip such as from the series of chips designated LM139 available from the National Semiconductor Company. One of the comparators 58 the quad voltage comparator chip monitors for a low voltage condition, another of the comparators 60 monitors for the presence of gases or fumes or for the depletion of oxygen in the ambient atmosphere, and a third comparator 62 monitors for an open circuit failure of the variable impedance element 34 of the gas sensor 28. The outputs of the comparators 58, 60 and 62 are connected in common and to one of the inputs of another comparator 64 in the quad comparator chip. The output 93 of the comparator 64 is used for controlling the energizing of the warning circuit 56.

The voltage across the voltage reference diode 52 is connected by lead 66 to the minus or negative input of the comparator 58, and the adjustable tap 42 of the potentiometer 32 is connected to the plus or positive input of the same comparator 58 by lead 68. The output 70 of the comparator 58, and of the other comparators 60 and 62, is connected to an output bus 72 which will be further described. The corner terminal 46 of the bridge circuit 24 is connected to the minus input of the comparator 60 by lead 74, the adjustable tap 38 of the potentiometer 30 is connected to the plus terminal of the comparator 60 by lead 76, and the output 78 of the comparator 60 is connected to the output bus 72. The corner terminal 44 of the bridge circuit 24 is connected to the minus input of the comparator 62 by lead 80, the plus input of the comparator 62 is connected to the bridge corner terminal 46 by lead 82, and the output 84 of the comparator 62 is likewise connected to the output bus 72.

The minus input of the comparator 64 is connected to the output bus 72 by lead 86, and the plus input of the comparator 64 is connected to the adjustable tap 38 of the potentiometer 30 by lead 88. A resistor 90 is connected between the output bus 72 and the positive terminal 25 of the bridge circuit 24 by lead 92, and the output 93 of the comparator 64 is connected as an input to the warning circuit 56 by lead 94.

The warning circuit 56 includes a transistor switch 96 which, when turned on by a signal present on the output 93 of the comparator 64, energizes a warning LED 98 connected in series with a resistor 100 which are in parallel with an audio warning element 102. A biasing resistor 104 is also connected between the base of the switching transistor 96 and the positive voltage supply present on the lead 92. The emitter of the transistor 96 is connected to ground. The LED 98 may be of a suitable color such as red which, when energized, indicates that a warning condition exists.

The circuit 10 is placed in operation by closing the switch 18, and after a few minutes allowed for the heater 36 to bring the variable impedance element 34 of the sensor 28 to its stabilized operating temperature, the circuit is in condition for monitoring. The adjustable tap 42 of the potentiometer 32 is next adjusted so that the voltage on the lead 68 is at some desired operating voltage that is necessarily higher than the voltage on the lead 66, providing a positive voltage on the output 70 of the comparator 58. This condition means that the voltage of the battery 16 is sufficiently high to properly operate the device 10. The adjustable tap 38 of the potentiometer 30 is there adjusted to establish a condition in which the voltage on the lead 76 is sufficiently higher than the voltage on the lead 74 to maintain the voltage on the output 78 of the comparator 60 in a positive condition indicating that there are no contaminating fumes or gases in the ambient atmosphere. Since the output 78 of the comparator 60 is connected to the output 70 of the comparators 58 it is necessary that the inputs to both comparators be such as to produce the operating conditions set forth above. If the gas sensor 28 is properly connected into the bridge circuit 24, and the variable impedance element 34 of the sensor 28 has not failed in an open circulated condition, the voltage on the output 84 of the comparator 62 will also be positive to cooperate with the positive outputs of the comparators 58 and 60. Under these conditions the voltage on the output bus 72 and on the lead 86 will be more positive than the voltage on the lead 88 thereby holding the voltage on the output 93 of the comparator 64 in a low condition, thereby maintaining the transistor switch 96 in the off or nonconducting condition.

If the voltage on the lead 68 falls below or becomes more negative than the reference voltage on the lead 66 indicating a low voltage condition, the output 70 of the comparator 58 will go to a low condition. If the voltage on the lead 76 becomes more negative than the voltage on the lead 74 indicating contaminating gases, fumes or a depletion of oxygen in the ambient atmosphere, the output 78 of the comparator 60 will go to a low condition. Also, if the voltage on lead 82 goes more negative than the voltage on lead 80, indicating that the element 34 of the sensor 28 has failed in the open circuit condition, the output 84 of the comparator 62 will go to a low condition. Thus if the output of any one of the voltage comparators 58, 60 or 62 goes to the low condition, it will cause the voltage on the output bus 72 to be pulled down to a low condition so that the voltage on the lead 86 will go more negative than the voltage on the lead 88. This in turn will cause a positive voltage to occur on the output 93 of the comparator 64 and on the lead 94, thereby turning on the transistor switch 96 to energize the alarm device 102 to sound an audible alarm and to illuminate the LED 98. On the other hand if the variable impedance element 34 of the gas sensor 28 should fail in the short circuit condition, the current through the load resistor 29 will substantially increase, thereby also substantially raising the voltage across the load resistor 29. This will also energize the warning circuit 56 as described.

The connections to a remote warning device may be made by connections to the circuit terminals 106 and 108 in the warning circuit 56 to give a warning at a remote location of the unsafe or circuit failure conditions.

Thus there has been shown and described a novel fume detector device with fail safe warning features which fulfills all of the objects and advantages sought therefor. It will be apparent to those skilled in the art, however, that many changes, modifications, variations, and other uses and application for the subject device are possible. All such changes, modifications, variations, and other uses and applications which do not depart from the spirit and scope of the invention are deemed to be covered by the invention which is limited only by the claims which follow.

What is claimed is:

1. A fume detector apparatus for monitoring a predetermined atmosphere comprising an electric circuit including a Wheatstone bridge having a pair of input and a pair of output connections, a source of energy and means connecting the energy source across the pair of bridge input connections, said bridge circuit including parallel impedance paths connected across the input connections, one of the parallel paths being formed by a sensor element whose impedance varies with the condition of the atmosphere being monitored in series with another impedance, the other parallel path being formed by series connected impedance devices, an alarm device, and means connected between the Wheatstone bridge and the alarm device including a first circuit operatively connected across the bridge output connections for detecting a first bridge voltage condition, a second circuit operatively connected across a selected portion of the other parallel bridge path for detecting a second bridge voltage condition, a third circuit operatively connected across selected portions of both parallel bridge paths for detecting a third bridge voltage condition thereacross, each of said first, second and third circuits having respective inputs connected to the bridge circuit and output connections, the output connections of said first, second and third circuits being connected together to a common connection, and a fourth circuit having a first input connected to the common output connection and a second input connected to the bridge circuit at a location therein so as to respond to any one of said voltage conditions detected by the first, second and third circuit, said fourth circuit having an output connection operatively connected to the alarm device.

2. The fume detector apparatus of claim 1 wherein a voltage condition less than some predetermined voltage on one of the inputs of one of said first, second and third circuits indicates that the voltage of the energy source is below a predetermined voltage.

3. The fume detector apparatus of claim 2 wherein a voltage condition less than some preselected voltage condition on one of the inputs of another one of said first, second and third circuits indicates an open circuit condition in one of the parallel impedance paths of the bridge circuit.

4. The fume detector apparatus of claim 3 wherein a voltage condition less than some predetermined voltage on one of the inputs of the remaining one of said first, second and third circuits indicates an unsafe condition of the atmosphere being monitored.

5. The fume detector apparatus of claim 1 wherein said first, second, third and fourth circuits include voltage comparator circuits operatively connected to said bridge circuit for detecting voltage conditions in the bridge voltage.

6. The fume detector apparatus of claim 5 including a source of reference voltage connected to one of said first second and third circuits for comparison with a preselectable portion of the voltage of said energy source.

7. The fume detector apparatus of claim 5 wherein a diode is operatively connected across the input to the comparator of one of said first, second and third circuits to establish a reference voltage therefor.

8. The fume detector of claim 1 wherein the impedance devices of said other parallel path include a pair of potentiometers each having opposite ends and an adjustable tap, said potentiometers being connected into the Wheatstone bridge such that the adjustable tap of one of the potentiometers adjusts the voltage detectable by one of said second and third electric circuits, and the adjustable tap of the other potentiometer adjusts the voltage detectable by the other of said second and third electric circuits.

9. The fume detector of claim 8 wherein the adjustable tap of one of said potentiometers is connected to the second electric circuit for detecting when the voltage of said energy source falls below a predetermined voltage, and the adjustable tap of the other potentiometer is connected to the third electric circuit for detecting an unsafe condition of the atmosphere being monitored.

10. The fume detector of claim 1 including a heater element associated with the sensor element and operatively connected to the energy source, said heater element maintaining the sensor element at a predetermined operating temperature.

11. A self-contained fume detector comprising:

a battery;

a gas sensor circuit operatively connected across said battery, said gas sensor circuit including an output terminal having a voltage thereon which increases when said gas sensor circuit is subjected to at least one of contaminating gases, contaminating fumes and a decrease in free oxygen in the ambient atmosphere;

means operatively connected to said battery for establishing a predetermined reference voltage;

a voltage divider circuit connected in parallel with said gas sensor circuit and having at least three output terminals;

a first voltage comparator having two inputs and an output, one input being connected to said means for establishing a reference voltage and the other input being connected to one of the three output terminals of the voltage divider circuit;

a second voltage comparator having two inputs and an output, one input being connected to the output terminal of said gas sensor circuit and the other input being connected to a second one of the three output terminals of the voltage divider circuit;

a third voltage comparator having two inputs and an output, one input being connected to the output terminal of said gas sensor circuit and the other input being connected to a third one of the three output terminals of the voltage divider circuit;

means connecting the output terminals of said first, second and third voltage comparators together;

a fourth voltage comparator having two inputs and an output, one input being connected to said common connected output terminals of the first, second and third comparators and the other input being connected to a selected one of the three output terminals of the voltage divider circuit such that if the output voltage on any one of the three output terminals decreases below some predetermined voltage it will product a change in the voltage on the output of said fourth comparator;

switch means operatively connected to the output of said fourth comparator including means responsive to said voltage change on the output of said fourth comparator due to the decrease on any one of the three comparator output terminals below said predetermined voltage to produce a switching operation; and, alarm means operatively connected to said switch means for giving an alarm signal whenever the switch means are in a switching operation.

12. The fume detector of claim 11 including a control switch in the circuit with said battery, said control switch having an operative condition, means operatively connected to the battery for indicating the operative condition of said control switch.

* * * * *

UNITED STATES PATENT OFFICE

CERTIFICATE OF CORRECTION

Patent No. 4,352,087 Dated September 28, 1982

Inventor(s) Edward A. Wittmaier

It is certified that error appears in the above-identified patent and that said Letters Patent are hereby corrected as shown below:

Col. 1, line 5, "of" should be "or"

Col. 2, line 42, "26" should be "36"

Signed and Sealed this

Tenth Day of May 1983

[SEAL]

Attest:

GERALD J. MOSSINGHOFF

Attesting Officer

Commissioner of Patents and Trademarks